US008056625B2

(12) United States Patent
Villareal et al.

(10) Patent No.: US 8,056,625 B2
(45) **Date of Patent: *Nov. 15, 2011**

(54) FORMATION EVALUATION WHILE DRILLING

(75) Inventors: Steven G. Villareal, Houston, TX (US); Reinhart Ciglenec, Katy, TX (US); Michael J. Stucker, Sugar Land, TX (US); Khanh Duong, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 10 days.

This patent is subject to a terminal disclaimer.

(21) Appl. No.: 12/496,950

(22) Filed: Jul. 2, 2009

(65) Prior Publication Data

US 2010/0170717 A1 Jul. 8, 2010

Related U.S. Application Data

(63) Continuation of application No. 11/313,004, filed on Dec. 19, 2005, now Pat. No. 7,367,394.

(51) Int. Cl.
*E21B 49/08* (2006.01)

(52) U.S. Cl. ..... 166/264; 175/59

(58) Field of Classification Search ..... 175/59; 166/264, 100

See application file for complete search history.

(56) References Cited

U.S. PATENT DOCUMENTS

| | | | | |
|---|---|---|---|---|
| 3,011,554 | A | | 12/1961 | Desbrandes |
| 3,437,138 | A | | 4/1969 | Scott |
| 3,611,799 | A | | 10/1971 | Davis |
| 3,859,851 | A | | 1/1975 | Urbanosky |
| 3,894,780 | A | | 7/1975 | Broussard |
| 4,416,152 | A | | 11/1983 | Wilson |
| 4,507,957 | A | | 4/1985 | Montgomery et al. |
| 4,583,595 | A | * | 4/1986 | Czernichow et al. ..... 166/264 |
| 4,750,570 | A | * | 6/1988 | Barrett ..... 175/4 |
| 4,856,585 | A | * | 8/1989 | White et al. ..... 166/323 |
| 5,036,916 | A | * | 8/1991 | Bennett ..... 166/253.1 |
| 5,337,822 | A | | 8/1994 | Massie et al. |
| 5,361,839 | A | * | 11/1994 | Griffith et al. ..... 166/264 |
| 5,540,280 | A | | 7/1996 | Schultz et al. |
| 5,704,425 | A | * | 1/1998 | Divis et al. ..... 166/191 |
| 5,743,343 | A | * | 4/1998 | Heller et al. ..... 175/20 |
| 5,803,186 | A | | 9/1998 | Berger et al. |
| 5,826,662 | A | | 10/1998 | Beck et al. |
| 6,006,834 | A | | 12/1999 | Skinner |
| 6,216,782 | B1 | | 4/2001 | Skinner |
| 6,467,544 | B1 | | 10/2002 | Brown et al. |
| 6,659,177 | B2 | | 12/2003 | Bolze et al. |
| 6,688,390 | B2 | | 2/2004 | Bolze et al. |
| 2002/0060067 | A1 | * | 5/2002 | Bolze et al. ..... 166/264 |
| 2003/0033866 | A1 | | 2/2003 | Diakonov et al. |
| 2003/0066646 | A1 | | 4/2003 | Shammai et al. |

(Continued)

FOREIGN PATENT DOCUMENTS

| | | |
|---|---|---|
| SU | 883381 | 11/1981 |

(Continued)

*Primary Examiner* — Shane Bomar
*Assistant Examiner* — Sean Andrish

(57) ABSTRACT

An apparatus comprising a fluid communication device configured to extend from a drill string and establish fluid communication with a subterranean formation penetrated by a wellbore in which the drill string is positioned, wherein the drill string comprises a passage configured to conduct drilling mud and an opening extending through an outer surface thereof and into a cavity. A sample chamber is coupled within the cavity and is in selectable fluid communication with the formation via the fluid communication device.

14 Claims, 10 Drawing Sheets

U.S. PATENT DOCUMENTS

2003/0098156 A1* 5/2003 Follini et al. ..... 166/264
2003/0221824 A1* 12/2003 Solfronk et al. ..... 166/133
2004/0007058 A1 1/2004 Rylander et al.
2004/0011525 A1 1/2004 Jones et al.
2004/0026125 A1 2/2004 Meister et al.
2004/0035199 A1 2/2004 Meister et al.
2004/0083805 A1 5/2004 Ramakrishnan et al.
2004/0089448 A1 5/2004 DiFoggio
2004/0106524 A1 6/2004 Jones et al.
2004/0163803 A1 8/2004 Ringgenberg et al.
2004/0163808 A1 8/2004 Ringgenberg et al.
2004/0195007 A1* 10/2004 Eppink ..... 175/61
2004/0216521 A1 11/2004 Shammai et al.
2004/0216874 A1* 11/2004 Grant et al. ..... 166/264
2004/0231841 A1 11/2004 Niemeyer et al.
2004/0231842 A1 11/2004 Shammai et al.
2004/0244971 A1 12/2004 Shammai et al.
2004/0245016 A1 12/2004 Chemali et al.
2004/0256161 A1 12/2004 Aronstam et al.
2005/0001624 A1 1/2005 Ritter et al.
2005/0011644 A1 1/2005 Krueger et al.
2005/0028973 A1* 2/2005 Paluch et al. ..... 166/264
2005/0028974 A1* 2/2005 Moody ..... 160/254
2005/0039527 A1 2/2005 Dhruva et al.
2005/0072565 A1 4/2005 Segura et al.
2005/0086699 A1 4/2005 Hahn et al.
2005/0109538 A1 5/2005 Fisseler et al.
2005/0150287 A1 7/2005 Carnegie et al.
2005/0205302 A1 9/2005 Meister et al.
2005/0235745 A1 10/2005 Proett et al.
2005/0246151 A1 11/2005 DiFoggio
2009/0126996 A1 5/2009 Villareal et al.

FOREIGN PATENT DOCUMENTS

WO WO 01/63093 8/2001

* cited by examiner

FORMATION EVALUATION WHILE DRILLING

CROSS-REFERENCE TO RELATED APPLICATIONS

This application is a continuation of and claims priority to U.S. application Ser. No. 11/313,004, now U.S. Pat. No. 7,367,394 ("the '394 patent"), entitled "FORMATION EVALUATION WHILE DRILLING," filed Dec. 19, 2005, and issued May 6, 2008, the entire disclosure of which is hereby incorporated herein by reference.

This application is also related to U.S. patent application Ser. No. 11/942,796 ("the '796 application"), entitled "FORMATION EVALUATION WHILE DRILLING," filed Nov. 20, 2007, which is a continuation-in-part of the '394 patent.

This application is also related to U.S. patent application Ser. No. 12/355,956, entitled "FORMATION EVALUATION WHILE DRILLING," filed Jan. 19, 2009, which is a continuation of the 796 application.

This application is also related to U.S. patent application Ser. No. 12/496,950, entitled "Formation Evaluation While Drilling," and filed concurrently herewith.

This application is also related to U.S. patent application Ser. No. 12/496,970, entitled "Formation Evaluation While Drilling," and filed concurrently herewith.

BACKGROUND OF THE DISCLOSURE

Wellbores are drilled to locate and produce hydrocarbons. A downhole drilling tool with a bit at and end thereof is advanced into the ground to form a wellbore. As the drilling tool is advanced, a drilling mud is pumped from a surface mud pit, through the drilling tool and out the drill bit to cool the drilling tool and carry away cuttings. The fluid exits the drill bit and flows back up to the surface for recirculation through the tool. The drilling mud is also used to form a mudcake to line the wellbore.

During the drilling operation, it is desirable to perform various evaluations of the formations penetrated by the wellbore. In some cases, the drilling tool may be provided with devices to test and/or sample the surrounding formation. In some cases, the drilling tool may be removed and a wireline tool may be deployed into the wellbore to test and/or sample the formation. See, for example, U.S. Pat. Nos. 4,860,581 and 4,936,139. In other cases, the drilling tool may be used to perform the testing and/or sampling. See, for example, U.S. Pat. Nos. 5,233,866; 6,230,557; 7,114,562 and 6,986,282. These samples and/or tests may be used, for example, to locate valuable hydrocarbons.

Formation evaluation often requires that fluid from the formation be drawn into the downhole tool for testing and/or sampling. Various fluid communication devices, such as probes, are typically extended from the downhole tool and placed in contact with the wellbore wall to establish fluid communication with the formation surrounding the wellbore and to draw fluid into the downhole tool. A typical probe is a circular element extended from the downhole tool and positioned against the sidewall of the wellbore. A rubber packer at the end of the probe is used to create a seal with the wellbore sidewall.

Another device used to form a seal with the wellbore sidewall is referred to as a dual packer. With a dual packer, two elastomeric rings expand radially about the tool to isolate a portion of the wellbore therebetween. The rings form a seal with the wellbore wall and permit fluid to be drawn into the isolated portion of the wellbore and into an inlet in the downhole tool.

The mudcake lining the wellbore is often useful in assisting the probe and/or dual packers in making the seal with the wellbore wall. Once the seal is made, fluid from the formation is drawn into the downhole tool through an inlet by lowering the pressure in the downhole tool. Examples of probes and/or packers used in downhole tools are described in U.S. Pat. Nos. 6,301,959; 4,860,581; 4,936,139; 6,585,045; 6,609,568; 6,719,049; and 6,964,301.

In cases where a sample of fluid drawn into the tool is desired, a sample may be collected in one or more sample chambers or bottles positioned in the downhole tool. Examples of such sample chambers and sampling techniques used in wireline tools are described in U.S. Pat. Nos. 6,688,390; 6,659,177; and 5,303,775. Examples of such sample chambers and sampling techniques used in drilling tools are described in U.S. Pat. Nos. 5,233,866 and 7,124,819. Typically, the sample chambers are removable from the downhole tool as shown, for example, in U.S. Pat. Nos. 6,837,314; 4,856,585; and 6,688,390.

Despite these advancements in sampling technology, there remains a need to provide sample chamber and/or sampling techniques capable of providing more efficient sampling in harsh drilling environments. It is desirable that such techniques are usable in the limited space of a downhole drilling tool and provide easy access to the sample. Such techniques preferably provide one or more of the following, among others: selective access to and/or removal of the sample chambers; locking mechanisms to secure the sample chamber; isolation from shocks, vibrations, cyclic deformations and/or other downhole stresses; protection of sample chamber sealing mechanisms; controlling thermal stresses related to sample chambers without inducing concentrated stresses or compromising utility; redundant sample chamber retainers and/or protectors; and modularity of the sample chambers. Such techniques are also preferably achieved without requiring the use of high cost materials to achieve the desired operability.

SUMMARY OF THE DISCLOSURE

In at least one aspect, the present disclosure relates to a sample module for a sampling while drilling tool positionable in a wellbore penetrating a subterranean formation is provided. The tool includes a drill collar, at least one sample chamber, at least one flowline and at least one cover. The drill collar is operatively connectable to a drill string of the sampling while drilling tool. The drill collar has at least one opening extending through an outer surface thereof and into a cavity. The drill collar has a passage therein for conducting mud therethrough. The sample chamber is positionable in the cavity of the drill collar. The flowline in the drill collar, the at least one flowline operatively connectable to the sample chamber for passing a downhole fluid thereto. The cover is positionable about the at least one opening of the drill collar whereby the sample chamber is removably secured therein.

In another aspect, the disclosure relates to a downhole sampling while drilling tool positionable in a wellbore penetrating a subterranean formation. The sampling tool includes a fluid communication device, a drill collar, at least one sample chamber, at least one flowline and at least one cover. The fluid communication device is operatively connectable to a drill string of the sampling while drilling tool and extendable therefrom for establishing fluid communication with the formation. The fluid communication device has an inlet for receiving formation fluid. The drill collar is operatively connectable to a drill string, the drill collar having at least one opening extending through an outer surface thereof and into a cavity. The drill collar has a passage therein for conducting mud therethrough. The sample chamber is positionable in the cavity of the drill collar. The flowline is in the drill collar. The flowline is fluidly connectable to inlet and the sample chamber for passing a downhole fluid therebetween. The cover is positionable about the at least one opening of the drill collar whereby the sample chamber is removably secured therein.

Finally, in another aspect, the disclosure relates to a method of sampling while drilling via a downhole sampling while drilling tool positionable in a wellbore penetrating a subterranean formation. The method involves positioning a sample chamber through an opening in an outer surface of a drill collar of the sampling while drilling tool and into a cavity therein, positioning a cover over the opening of the drill collar, deploying the downhole sampling while drilling tool into the wellbore, establishing fluid communication between the sampling while drilling tool and the formation, drawing a formation fluid into the sampling while drilling tool via an inlet in the sampling while drilling tool and passing the formation fluid from the inlet to the sample chamber.

Other aspects of the disclosure may be discerned from the description.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
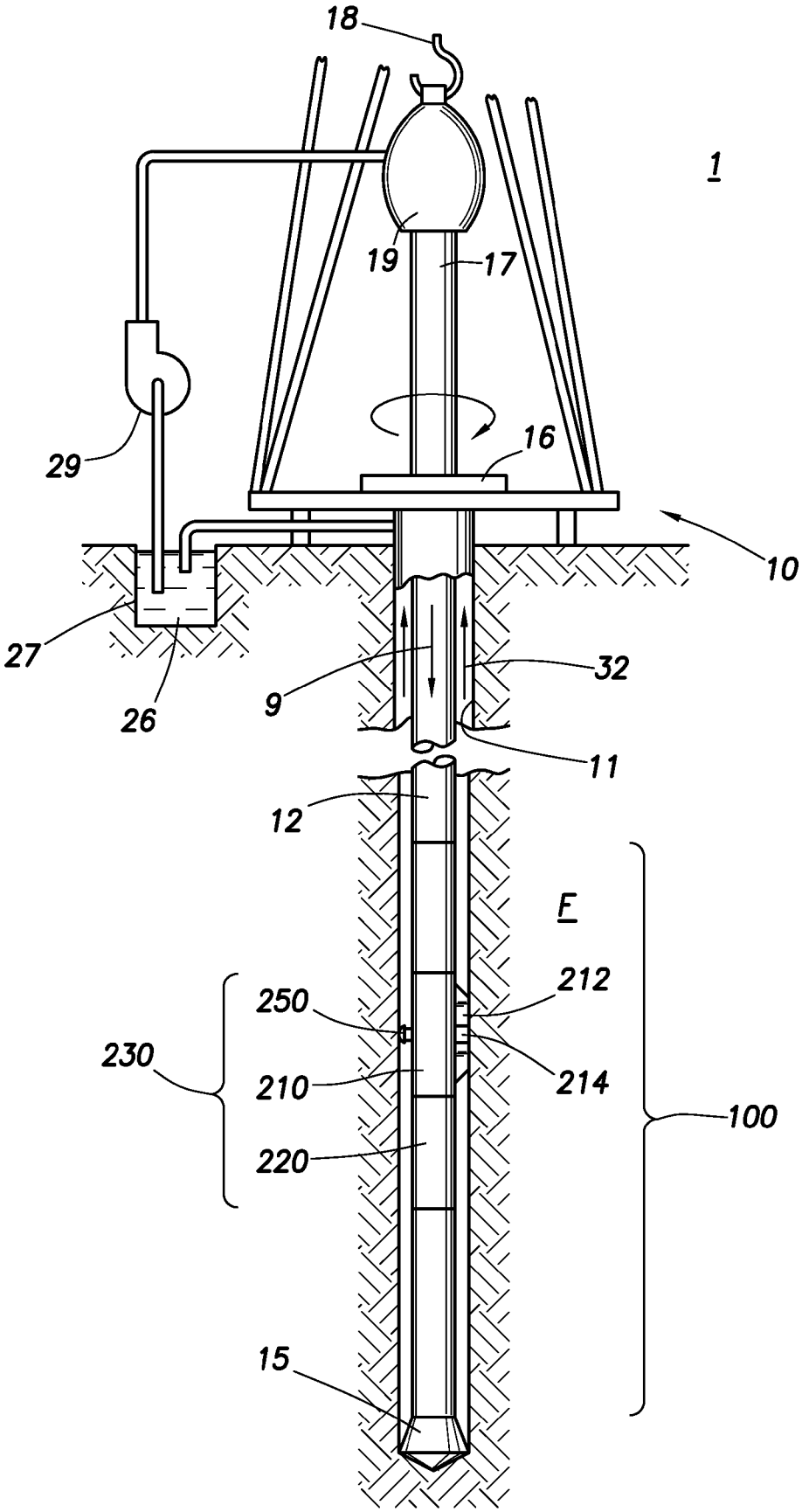
FIG. 1 is an schematic representation of a wellsite having a downhole tool positioned in a wellbore penetrating a subterranean formation, the downhole tool having a sampling while drilling ("SWD") system.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Certain terms are defined throughout this description as they are first used, while certain other terms used in this description are defined below:

"Electrical" and "electrically" refer to connection(s) and/or line(s) for transmitting electronic signals.

"Electronic signals" mean signals that are capable of transmitting electrical power and/or data (e.g., binary data).

"Module" means a section of a downhole tool, particularly a multi-functional or integrated downhole tool having two or more interconnected modules, for performing a separate or discrete function.

"Modular" means adapted for (inter)connecting modules and/or tools, and possibly constructed with standardized units or dimensions for flexibility and variety in use.

"Single phase" refers to a fluid sample stored in a sample chamber, and means that the pressure of the chamber is maintained or controlled to such an extent that sample constituents which are maintained in a solution through pressure only, such as gasses and asphaltenes, should not separate out of solution as the sample cools upon retrieval of the chamber from a wellbore.

FIG. 1 depicts a wellsite 1 including a rig 10 with a downhole tool 100 suspended therefrom and into a wellbore 11 via a drill string 12. The downhole tool 10 has a drill bit 15 at its lower end thereof that is used to advance the downhole tool into the formation and form the wellbore.

The drillstring 12 is rotated by a rotary table 16, energized by means not shown, which engages a kelly 17 at the upper end of the drillstring. The drillstring 12 is suspended from a hook 18, attached to a traveling block (also not shown), through the kelly 17 and a rotary swivel 19 which permits rotation of the drillstring relative to the hook.

The rig is depicted as a land-based platform and derrick assembly 10 used to form the wellbore 11 by rotary drilling in a manner that is well known. Those of ordinary skill in the art given the benefit of this disclosure will appreciate, however, that the present invention also finds application in other downhole applications, such as rotary drilling, and is not limited to land-based rigs.

Drilling fluid or mud 26 is stored in a pit 27 formed at the well site. A pump 29 delivers drilling fluid 26 to the interior of the drillstring 12 via a port in the swivel 19, inducing the drilling fluid to flow downwardly through the drillstring 12 as indicated by a directional arrow 9. The drilling fluid exits the drillstring 12 via ports in the drill bit 15, and then circulates upwardly through the region between the outside of the drillstring and the wall of the wellbore, called the annulus, as indicated by direction arrows 32. In this manner, the drilling fluid lubricates the drill bit 15 and carries formation cuttings up to the surface as it is returned to the pit 27 for recirculation.

The downhole tool 100, sometimes referred to as a bottom hole assembly ("BHA"), is preferably positioned near the drill bit 15 (in other words, within several drill collar lengths from the drill bit). The bottom hole assembly includes various components with capabilities, such as measuring, processing, and storing information, as well as communicating with the surface. A telemetry device (not shown) is also preferably provided for communicating with a surface unit (not shown).

The BHA 100 further includes a sampling while drilling ("SWD") system 230 including a fluid communication module 210 and a sample module 220. The modules are preferably housed in a drill collar for performing various formation evaluation functions (described in detail below). As shown in FIG. 1, the fluid communication module 210 is preferably positioned adjacent the sample module 220. The fluid communication module is depicted as having a probe with an inlet for receiving formation fluid. Additional devices, such as pumps, gauges, sensor, monitors or other devices usable in downhole sampling and/or testing may also be provided. While FIG. 1 is depicted as having a modular construction with specific components in certain modules, the tool may be unitary or select portions thereof may be modular. The modules and/or the components therein may be positioned in a variety of configurations throughout the downhole tool.

The fluid communication module 210 has a fluid communication device 214, such as a probe, preferably positioned in a stabilizer blade or rib 212. An exemplary fluid communication device that can be used is depicted in US patent Application No. 20050109538, the entire contents of which are hereby incorporated by reference. The fluid communication device is provided with an inlet for receiving downhole fluids and a flowline (not shown) extending into the downhole tool for passing fluids therethrough. The fluid communication device is preferably movable between extended and retracted positions for selectively engaging a wall of the wellbore 11 and acquiring a plurality of fluid samples from the formation F. As shown, a back up piston 250 may be provided to assist in positioning the fluid communication device against the wellbore wall.

Examples of fluid communication devices, such as probes or packers, that can be used, are described in greater detail in U.S. Patent/Application Nos. US 2005/0109538 and U.S. Pat. No. 5,803,186. A variety of fluid communication devices alone or in combination with protuberant devices, such as stabilizer blades or ribs, may be used.

Figure 2A:
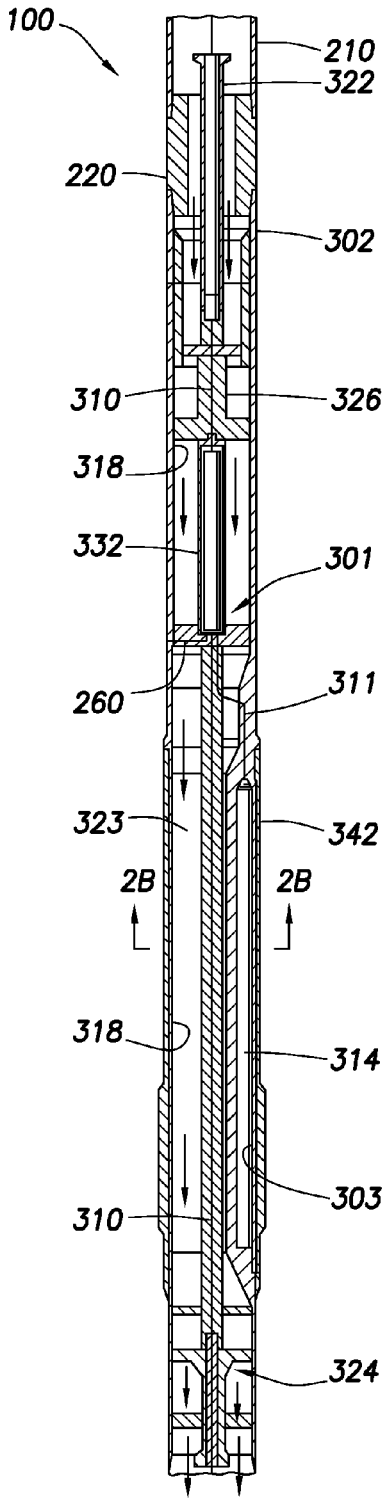
FIG. 2A is a longitudinal cross-sectional representation of a portion of the downhole tool of FIG. 1 depicting a sample module of the SWD system in greater detail, the sample module having a fluid flow system and a plurality of sample chambers therein.
Figure 2B:
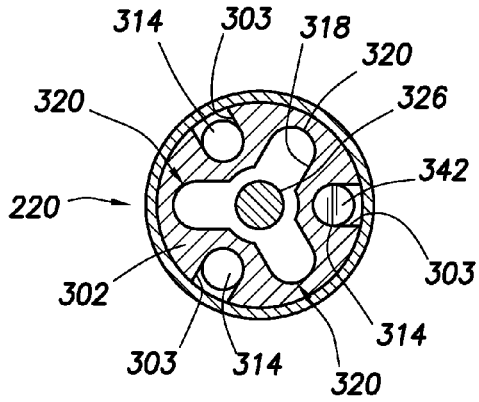
FIG. 2B is a horizontal cross-sectional representation of the sample module of FIG. 2A, taken along section line 2B-2B.

FIGS. 2A and 2B depict a portion of the downhole tool 100 with the sample module 220 of FIG. 1 shown in greater detail. FIG. 2A is a longitudinal cross-section of a portion of the fluid communication module 210 and the sample module 220. FIG. 2B is a horizontal cross-sectional of the sample module 220 taken along section line 2B-2B of FIG. 2A.

The sample module 220 is preferably housed in a drill collar 302 that is threadably connectable to adjacent drill collars of the BHA, such as the fluid communication module 210 of FIG. 1. The drill collar has a mandrel 326 supported therein. A passage 323 extends between the mandrel and the drill collar to permit the passage of mud therethrough as indicated by the arrows.

The sample chamber, drill collar and associated components may be made of high strength materials, such as stainless steel alloy, titanium or inconel. However, the materials may be selected to achieve the desired thermal expansion matching between components. In particular, it may be desirable to use a combination of low cost, high strength and limited thermal expansion materials, such as peek or kevlar.

Interface 322 is provided at an end thereof to provide hydraulic and/or electrical connections with an adjacent drill collar. An additional interface 324 may be provided at another end to operatively connect to adjacent drill collars if desired. In this manner, fluid and/or signals may be passed between the sample module and other modules as described, for example, in U.S. patent application Ser. No. 11/160,240. In this case, such an interface is preferably provided to establish fluid communication between the fluid communication module and the sample module to pass formation fluid received by the fluid communication module to the sample module.

Interface 322 is depicted as being at an uphole end of the sample module 220 for operative connection with adjacent fluid communication module 210. However, it will be appreciated that one or more fluid communication and/or probe modules may be positioned in the downhole tool with one or more interfaces at either or both ends thereof for operative connection with adjacent modules. In some cases one or more intervening modules may be positioned between the fluid communication and probe modules.

The sample module has fluid flow system 301 for passing fluid through the drill collar 302. The fluid flow system includes a primary flow line 310 that extends from the interface and into the downhole tool. The flowline is preferably in fluid communication with the flowline of the fluid communication module via the interface for receiving fluids received thereby. As shown, the flowline is positioned in mandrel 326 and conducts fluid, received from the fluid communication module through the sample module.

As shown, the fluid flow system 301 also has a secondary flowline 311 and a dump flowline 260. The secondary flowline diverts fluid from the primary flowline 310 to one or more sample chambers 314 for collection therein. Additional flowlines, such as dump flowline 260 may also be provided to divert flow to the wellbore or other locations in the downhole tool. As shown, a flow diverter 332 is provided to selectively divert fluid to various locations. One or more such diverters may be provided to divert fluid to desired locations.

The sample chambers may be provided with various devices, such as valves, pistons, pressure chambers or other devices to assist in manipulating the capture of fluid and/or maintaining the quality of such fluid. The sample chambers 314 are each adapted for receiving a sample of formation fluid, acquired through the probe 214 (see FIG. 1), via the primary flow line 310 and respective secondary flow lines 311.

As shown, the sample chambers are preferably removably positioned in an aperture 303 in drill collar 302. A cover 342 is positioned about the sample chambers and drill collar 302 to retain the sample chambers therein.

As seen in the horizontal cross-section taken along line 2B-2B of FIG. 2A and shown in FIG. 2B, the sample module is provided with three sample chambers 314. The sample chambers 314 are preferably evenly spaced apart within the body at 120° intervals. However, it will be appreciated that one or more sample chambers in a variety of configurations may be positioned about the drill collar. Additional sample chambers may also be positioned in additional vertical locations about the module and/or downhole tool.

The chambers are preferably positioned about the periphery of the drill collar 302. As shown the chambers are removably positioned in apertures 303 in the drill collar 302. The apertures are configured to receive the sample chambers. Preferably, the sample chambers fit in the apertures in a manner that prevents damage when exposed to the harsh wellbore conditions.

Passage 318 extends through the downhole tool. The passage preferably defines a plurality of radially-projecting lobes 320. The number of lobes 320 is preferably equal to the number of sample chambers 314, i.e., three in FIG. 2B. As shown, the lobes 320 project between the sample chambers 314 at a spacing interval of about 60° therefrom. Preferably, the lobes expand the dimension of the passage about the sample chambers to permit drilling fluid to pass therethrough.

The lobed bore 318 is preferably configured to provide adequate flow area for the drilling fluid to be conducted through the drillstring past the sample chambers 314. It is further preferred that the chambers and/or containers be positioned in a balanced configuration that reduces drilling rotation induced wobbling tendencies, reduces erosion of the downhole tool and simplifies manufacturing. It is desirable that such a configuration be provided to optimize the mechanical strength of the sample module, while facilitating fluid flow therethrough. The configuration is desirably adjusted to enhance the operability of the downhole tool and the sampling while drilling system.

Figure 3:
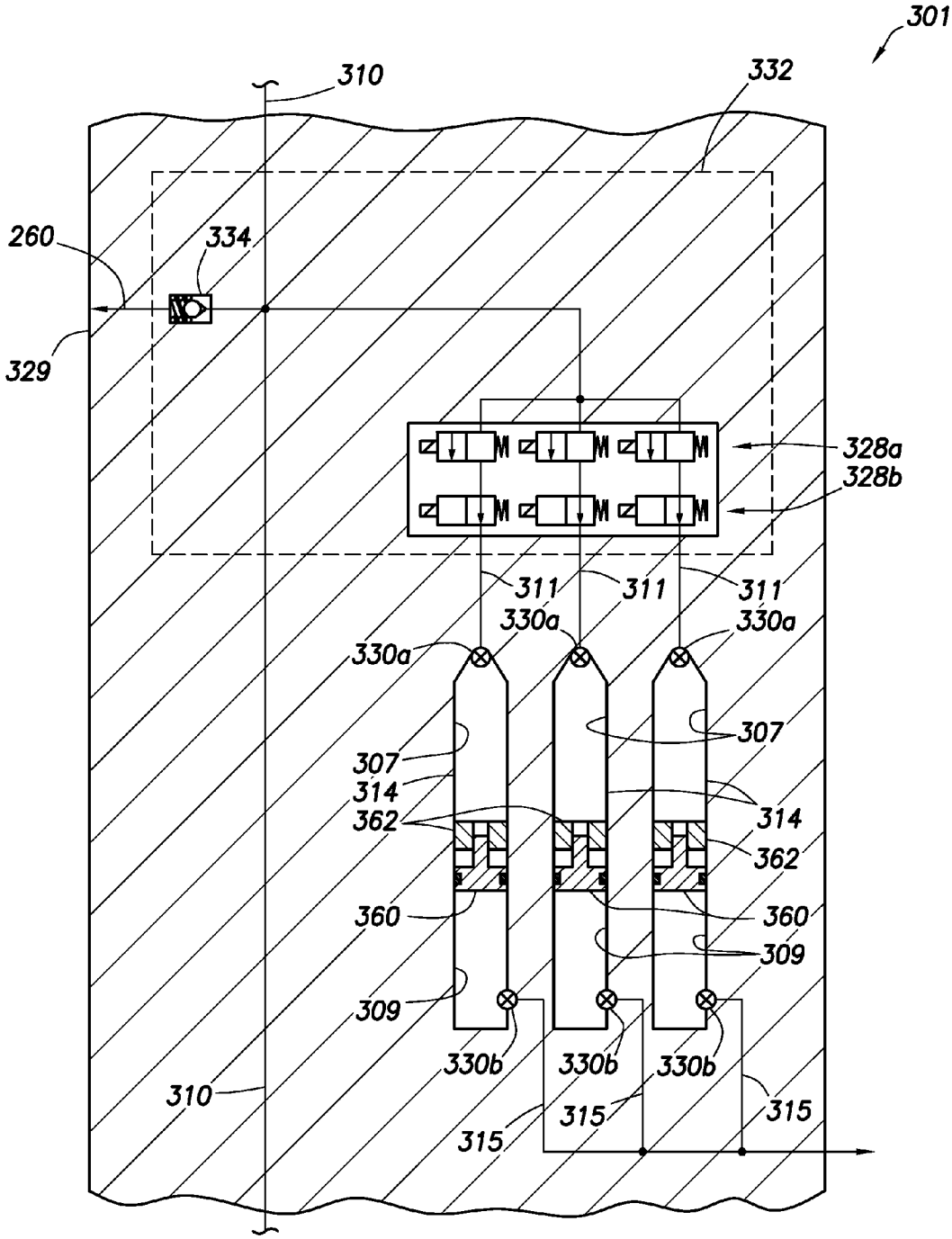
FIG. 3 is a schematic representation of the fluid flow system of FIGS. 2A and 2B.

FIG. 3 is a schematic representation of the fluid flow system 301 of the sample module 220 of FIGS. 2A-2B. As described above, the fluid flow system 301 includes a flow diverter 332 for selectively diverting flow through the sample module and a plurality of sample chambers 314. The flow diverter selectively diverts fluid from primary flowline 310 to secondary flowlines 311 leading to sample chambers 314 and/or a dump flowline 260 leading to the wellbore.

One or more flowlines valves may be provided to selectively divert fluid to desired locations throughout the downhole tool. In some cases, fluid is diverted to the sample chamber(s) for collection. In other cases, fluid may be diverted to the wellbore, the passage 318 or other locations as desired.

The secondary flowlines 311 branch off from primary flowline 310 and extend to sample chambers 314. The sample chambers may be any type of sample chamber known in the art to capture downhole fluid samples. As shown, the sample chambers preferably include a slidable piston 360 defining a variable volume sample cavity 307 and a variable volume buffer cavity 309. The sample cavity is adapted to receive and house the fluid sample. The buffer cavity typically contains a buffer fluid that applies a pressure to the piston to maintain a pressure differential between the cavities sufficient to maintain the pressure of the sample as it flows into the sample cavity. Additional features, such as pressure compensators, pressure chambers, sensors and other components may be used with the sample chambers as desired.

The sample chamber is also preferably provided with an agitator 362 positioned in the sample chamber. The agitator may be a rotating blade or other mixing device capable of moving the fluid in the sample chamber to retain the quality thereof.

Each sample chamber 314 is shown to have container valves 330*a*, 330*b*. Container valves 330*a* are preferably provided to selectively fluidly connect the sample cavity of the sample chambers to flowline 311. The chamber valves 330*b* selectively fluidly connect the buffer cavity of the sample chambers to a pressure source, such as the wellbore, a nitrogen charging chamber or other pressure source.

Each sample chamber 314 is also associated with a set of flowline valves 328*a*, 328*b* inside a flow diverter/router 332, for controlling the flow of fluid into the sample chamber. One or more of the flowline valves may be selectively activated to permit fluid from flowline 310 to enter the sample cavity of one or more of the sample chambers. A check valve may be employed in one or more flow lines to restrict flow therethrough.

Additional valves may be provided in various locations about the flowline to permit selective fluid communication between locations. For example, a valve 334, such as a relief or check valve, is preferably provided in a dump flowline 260 to allow selective fluid communication with the wellbore. This permits formation fluid to selectively eject fluid from the flowline 260. This fluid is typically dumped out dump flowline 260 and out the tool body's sidewall 329. Valve 334 may also be is preferably open to the wellbore at a given differential pressure setting. Valve 334 may be a relief or seal valve that is controlled passively, actively or by a preset relief pressure. The relief valve 334 may be used to flush the flowline 310 before sampling and/or to prevent over-pressuring of fluid samples pumped into the respective sample chambers 314. The relief valve may also be used as a safety to prevent trapping high pressure at the surface.

Additional flowlines and valves may also be provided as desired to manipulate the flow of fluid through the tool. For example, a wellbore flowline 315 is preferably provided to establish fluid communication between buffer cavities 309 and the wellbore. Valves 330*b* permit selective fluid communication with the buffer chambers.

In instances where multiple sample modules 220 are run in a tool string, the respective relief valves 334 may be operated in a selective fashion, e.g., so as to be active when the sample chambers of each respective module 220 are being filled. Thus, while fluid samples are routed to a first sample module 220, its corresponding relief valve 334 may be operable. Once all the sample chambers 314 of the first sample module 220 are filled, its relief valve is disabled. The relief valve of an additional sample module may then be enabled to permit flushing of the flow line in the additional sample module prior to sample acquisition (and/or over-pressure protection). The position and activation of such valves may be actuated manually or automatically to achieve the desired operation.

Valves 328*a*, 328*b* are preferably provided in flowlines 311 to permit selective fluid communication between the primary flowline 310 and the sample cavity 307. These valves may be selectively actuated to open and close the secondary flow lines 311 sequentially or independently.

The valves 328*a, b* are preferably electric valves adapted to selectively permit fluid communication. These valves are also preferably selectively actuated. Such valves may be provided with a spring-loaded stem (not shown) that biases the valves to either an open or closed position. In some cases, the valves may be commercially available exo or seal valves.

To operate the valves, an electric current is applied across the exo washers, causing the washers to fail, which in turn releases the springs to push their respective stems to its other, normal position. Fluid sample storage may therefore be achieved by actuating the (first) valves 328*a* from the displaced closed positions to the normal open positions, which allows fluid samples to enter and fill the sample chambers 314. The collected samples may be sealed by actuating the (second) valves 328*b* from the displaced open positions to the normal closed positions.

The valves are preferably selectively operated to facilitate the flow of fluid through the flowlines. The valves may also be used to seal fluid in the sample chambers. Once the sample chambers are sealed, they may be removed for testing, evaluation and/or transport. The valves 330*a* (valve 330*b* may remain open to expose the backside of the container piston 360 to wellbore fluid pressure) are preferably actuated after the sample module 220 is retrieved from the wellbore to provide physical access by an operator at the surface. Accordingly, a protective cover (described below) may be equipped with a window for quickly accessing the manually-operable valves—even when the cover is moved to a position closing the sample chamber apertures 313 (FIG. 4).

One or more of the valves may be remotely controlled from the surface, for example, by using standard mud-pulse telemetry, or other suitable telemetry means (e.g., wired drill pipe). The sample module 220 may be equipped with its own modem and electronics (not shown) for deciphering and executing the telemetry signals. Alternatively, one or more of the valves may be manually activated. Downhole processors may also be provided for such actuation.

Those skilled in the art will appreciate that a variety of valves can be employed. Those skilled in the art will appreciate that alternative sample chamber designs can be used. Those skilled in the art will appreciate that alternative fluid flow system designs can be used.

Figure 4A:
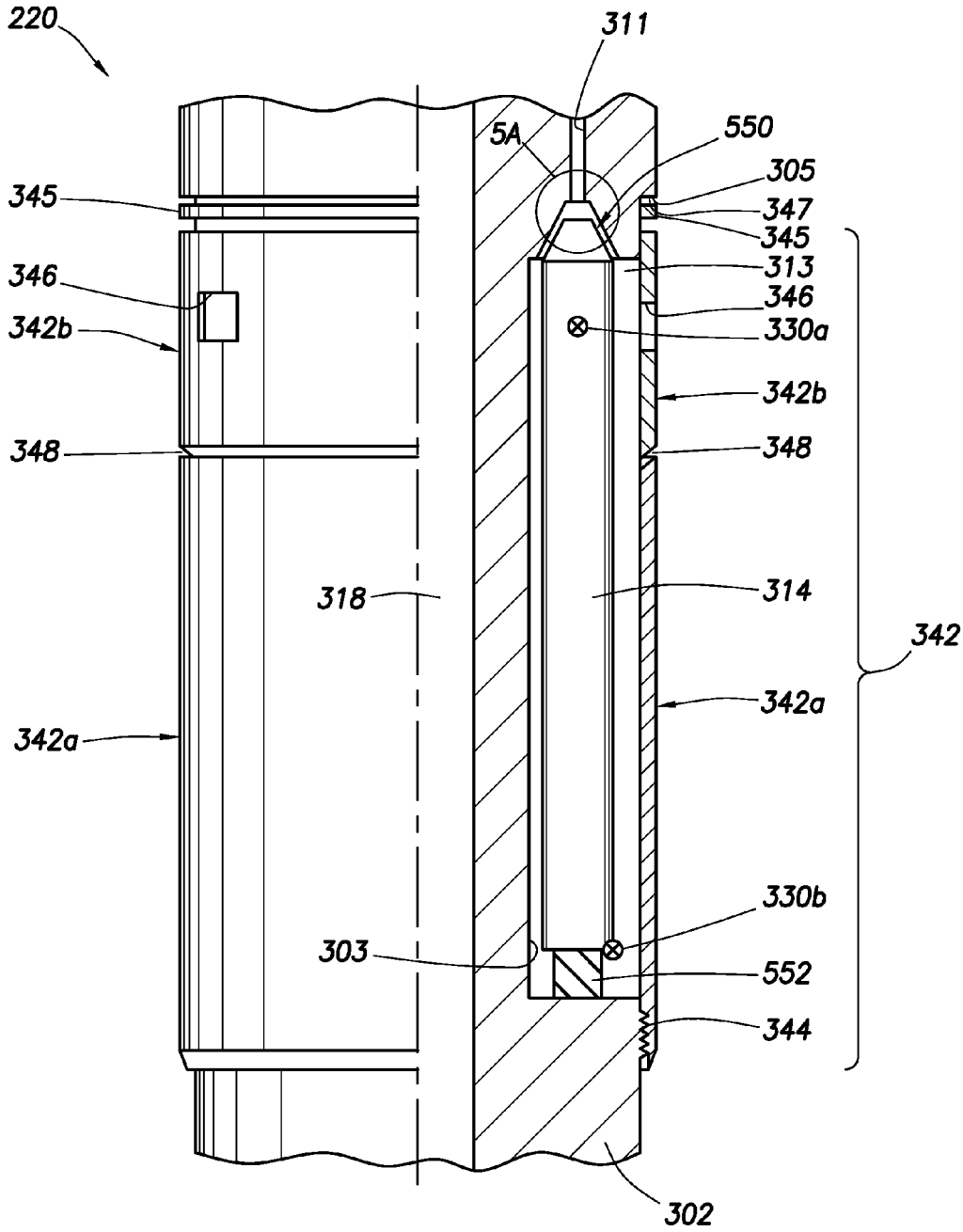
FIG. 4A is a partial sectional representation of the sample module of FIG. 2A having a removable sample chamber retained therein by a two piece cover.
Figure 4B:
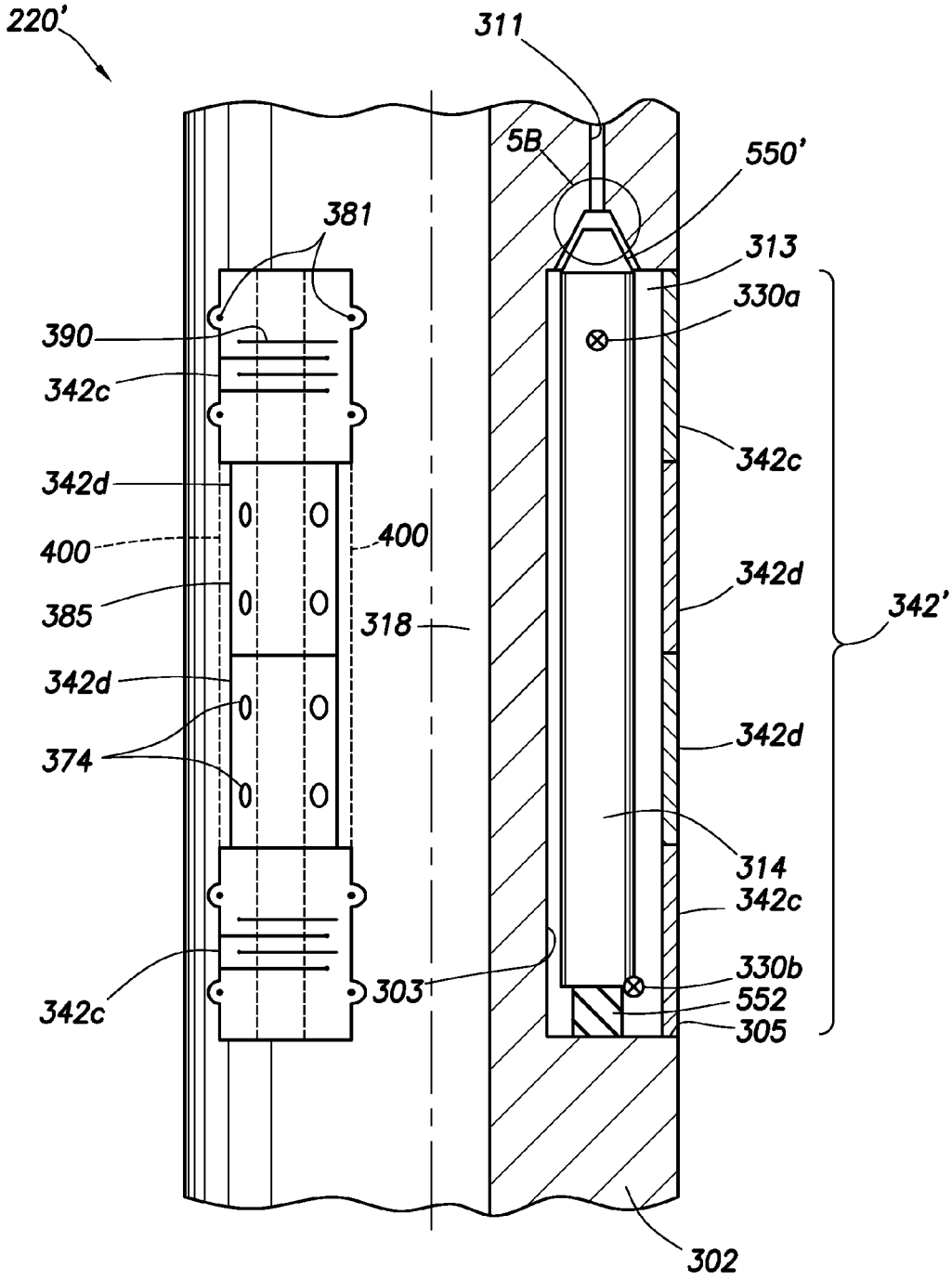
FIG. 4B is a partial sectional representation of an alternate sample module having a removable sample chamber retained therein by a multi-piece cover.

FIGS. 4A and 4B depict techniques for removably positioning sample chambers in the downhole tool. FIG. 4A depicts a sample chamber retained with the downhole tool by a cover, such as a ring or sleeve, slidably positionable about the outer surface of the drill collar to cover one or more openings therein. FIG. 4B depicts a cover, such as a plate or lid, positionable over an opening in the drill collar.

FIG. 4A is a partial sectional representation of the sample module 220, showing a sample chamber 314 retained therein. The sample chamber is positioned in aperture 303 in drill collar 302. The drill collar has a passage 318 for the passage of mud therethrough.

Cover 342 is positioned about the drill collar to retain the sample chamber in the downhole tool. The sample chambers 314 are positioned in the apertures 303 in drill collar 302. Cover 342 is preferably a ring slidably positionable about drill collar 302 to provide access to the sample chambers 314. Such access permits insertion and withdrawal of sample chamber 314 from the drill collar 302.

The cover 342 acts as a gate in the form of a protective cylindrical cover that preferably fits closely about a portion of the drill collar 302. The cover 342 is movable between positions closing (see FIG. 4A) and opening (not shown) the one or more apertures 303 in the drill collar. The cover thereby provides selective access to the sample chambers 314. The cover also preferably prevents the entry of large particles, such as cuttings, from the wellbore into the aperture when in the closed position.

The cover 342 may comprise one or more components that are slidable along drill collar 302. The cover preferably has an outer surface adapted to provide mechanical protection from the drilling environment. The cover is also preferably fitted about the sample chamber to seal the opening(s) and/or secure the sample chamber in position and prevent damage due to harsh conditions, such as shock, external abrasive forces and vibration.

The cover 342 is operatively connected to the drill collar 302 to provide selective access to the sample chambers. As shown, the cover has a first cover section 342*a* and a second cover section 342*b*. The first cover section 342*a* is held in place about drill collar 302 by connection means, such as engaging threads 344, for operatively connecting an inner surface of the first cover section 342*a* and an outer surface of the drill collar 302.

The cover may be formed as a single piece, or it may include two or more complementing sections. For example, FIG. 4A illustrates a two-piece cover 342 with first and second cover sections 342*a*, 342*b*. Both the first cover section 342*a* and second cover section 342*b* are preferably slidably positioned about an opening 305 the tool body 302. The first cover section 342*a* may be slid about the drill collar until it rests upon an downwardly-facing shoulder 347 of the body. A shim 345, or a bellows, spring-washer stack or other device capable of axial loading of the bottle to secure it in place, may be positioned between the shoulder 347 and the first cover section 342*a*. The second cover section 342*b* may also be slidably positioned about the drill collar 302. The cover sections have complementing stops (referenced as 348) adapted for operative connection therebetween. The second cover section may be operatively connected to the first cover section before or after positioning the covers sections about the drill collar. The first cover section is also threaded onto the drill collar at threaded connection 344.

The cover sections may then be rotated relative to the drill collar 302 to tighten the threaded connection 344 and secure the cover sections in place. Preferably, the covers are securably positioned to preload the cover sections and reduce (or eliminate) relative motion between the cover sections and the tool body 302 during drilling.

The cover 342 may be removed from drill collar 302 to access the sample chambers. For example, the cover 342 may be rotated to un-mate the threaded connection 344 to allow access to the sample chamber. The cover 342 may be provided with one or more windows 346. Window 346 of the cover 342 may be used to access the sample chamber 314. The window may be used to access valves 330*a*, 330*b* on the sample chamber 314. Window 346 permits the manual valve 330*a* to be accessed at the surface without the need for removing the cover 342. Also, it will be appreciated by those skilled in that art that a windowed cover may be bolted or otherwise operatively connected to the tool body 302 instead of being threadably engaged thereto. One or more such windows and/or covers may be provided about the drill collar to selectively provide access and/or to secure the sample chamber in the drill collar.

The sample chamber is preferably removably supported in the drill collar. The sample chamber is supported at an end thereof by a shock absorber 552. An interface 550 is provided at an opposite end adjacent flowline 311 to operatively connect the sample chamber thereto. The interface 550 is also preferably adapted to releasably secure the sample chamber in the drill collar. The interface and shock absorbers may be used to assist in securing the sample chamber in the tool body. These devices may be used to provide redundant retainer mechanisms for the sample chambers in addition to the cover 342.

FIG. 4B depicts an alternate sample module 220'. The sample module 220' is the same as the sample module 220 of FIG. 4A, except that the sample chamber 314' is retained in drill collar 302 by cover 342', an interface 550' and a shock absorber 552. The cover 342' includes a plurality of cover portions 342*c* and 342*d*.

Cover 342*d* is slidably positionable in opening 305 of the drill collar 302. Cover 342' is preferably a rectangular plate having an overhang 385 along an edge thereof. The cover may be inserted into the drill collar such that the overhang 385 engages an inner surface 400 of the drill collar. The overhang allows the cover to slidingly engage the inner surface of the drill collar and be retained therein. One or more covers 342*d* are typically configured such that they may be dropped into the opening 305 and slid over the sample chamber 314 (not shown) to the desired position along the chamber cavity opening. The covers may be provided with countersink holes 374 to aid in the removal of the cover 342*d*. The cover 342*d* may be configured with one or more windows, such as the window 346 of FIG. 4A.

Cover 342*c* is preferably a rectangular plate connectable to drill collar 302 about opening 305. The cover is preferably removably connected to the drill collar by bolts, screws or other fasteners. The cover may be slidably positionable along the drill collar and secured into place. The cover may be provided with receptacles 381 extending from its sides and having holes therethrough for attaching fasteners therethrough.

The covers as provided herein are preferably configured with the appropriate width to fit snuggly within the opening 305 of the drill collar. One or more such covers or similar or different configurations may be used. The covers may be provided with devices to prevent damage thereto, such as the strain relief cuts 390 in cover 342 of FIG. 4B. In this manner, the covers may act as shields.

Figure 5B:
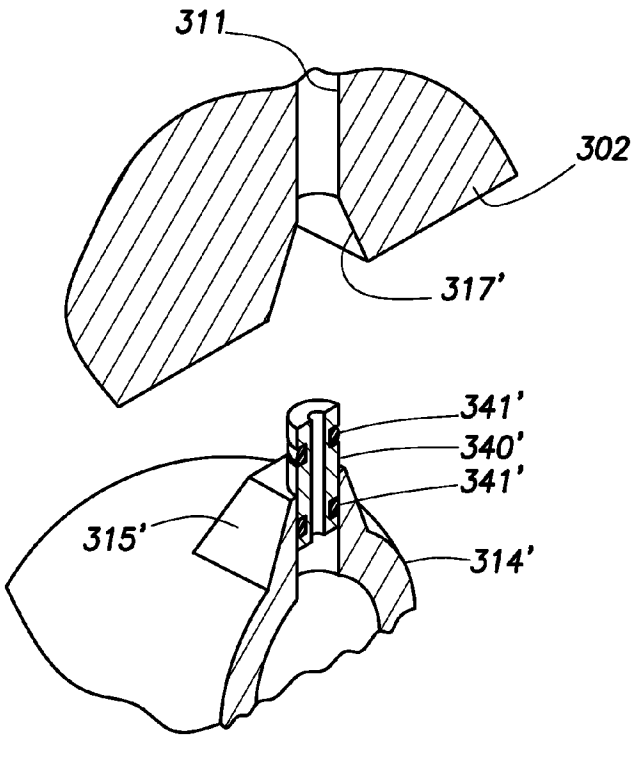
FIG. 5B is an isometric representation, partially in section, of an alternate sample module and interface.
Figure 5A:
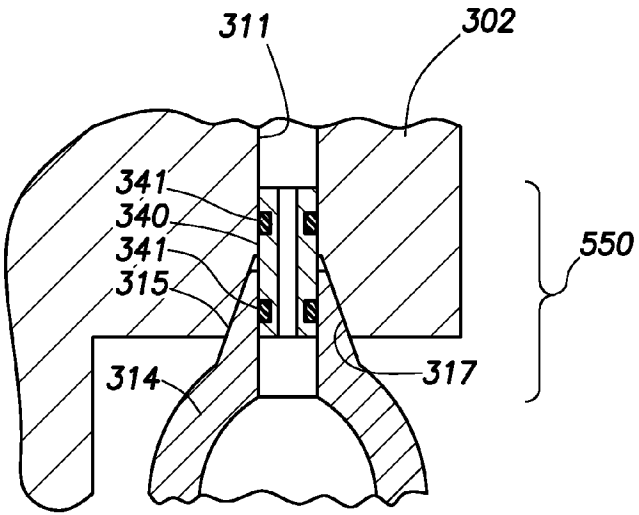
FIG. 5A is a detailed sectional representation of a portion of the sample module of FIG. 4A depicting an interface thereof in greater detail.

FIG. 5A is a detailed representation of a portion of the sample module of FIG. 4A depicting the interface 550 in greater detail. The interface includes a hydraulic stabber 340 fluidly connecting the sample chamber 314 disposed therein to one of the secondary flow lines 311. The sample chamber 314 has a conical neck 315 having an inlet for passing fluids therethrough. The upper portion of the hydraulic stabber 340 is in fluid-sealing engagement with the conical neck 315 of the sample chamber 314, and the lower portion of the hydraulic stabber in fluid-sealing engagement with the secondary flow line 311 of the drill collar 302.

Such retainer mechanisms are preferably positioned at each of the ends of the sample chambers to releasably retain the sample chamber. A first end of the sample chamber 314 may be laterally fixed, e.g., by sample chamber neck 315. An opposite end typically may also be provided with a retainer mechanism. Alternatively, the opposite end may be held in place by shock absorber 552 (FIG. 4A). These retainer mechanisms may be reversed or various combinations of retainer mechanisms may be used.

The conical neck 315 of the sample chamber 314 is supported in a complementing conical aperture 317 in the tool body 302. This engagement of conical surfaces constitutes a portion of a retainer for the sample chamber. The conical neck may be used to provide lateral support for the sample chamber 314. The conical neck may be used in combination with other mechanisms, such as an axial loading device (described below), to support the sample chamber in place. Preferably, little if any forces are acting on the hydraulic stabber 340 and its O-ring seals 341 to prevent wear of the stabber/seal materials and erosion thereof over time. The absence of forces at the hydraulic seals 341 preferably equates to minimal, if any, relative motion at the seals 341, thereby reducing the likelihood of leakage past the seals.

FIG. 5B is a detailed view of a portion of the sample module 220' of FIG. 4B with an alternate interface to that of FIG. 4A. The sample chamber 314' of FIG. 5B is equipped with double-wedge or pyramidal neck 315' that engages a complementing pyramidal aperture 317' in the tool body 302. Hydraulic stabber 340' is positioned in an inlet in pyramidal neck 315' for insertion into pyramidal aperture 317' for fluidly coupling the sample chamber to flowline 311. Hydraulic seals 341' are preferably provided to fluidly seal the sample chamber to the drill collar.

This pyramidal engagement provides torsional support for the sample chamber, and prevents it from rotating about its axis within the sample chamber. This functionality may be desirable to ensure a proper alignment of manually operated valves 330*a*' and 330*b*' within the opening 313 of the sample chambers 314.

FIGS. 6A-D illustrate a portion of the sample module 220 of FIG. 4A in greater detail. In these figures, the sample module 220 is provided with alternative configurations of retainers 552*a-d* usable as the shock absorbers 552 and/or 552' of FIGS. 4A-4B. These retainers assist in supporting sample chamber 314 within aperture 303 of drill collar 302. Cover 342 also assists in retaining sample chamber 314 in position. The retainer and/or cover also preferably provide shock absorption and otherwise assist in preventing damage to the sample chamber.

Figure 6B:
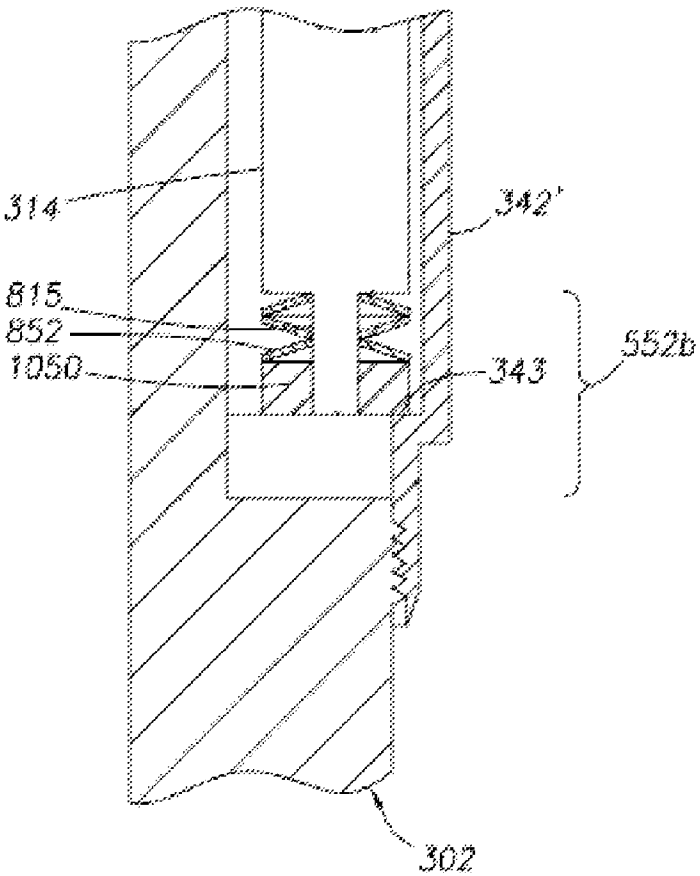
FIGS. 6A-6D are detailed sectional representations of a portion of the sample module of FIG. 4A depicting the shock absorber in greater detail.
Figure 6A:
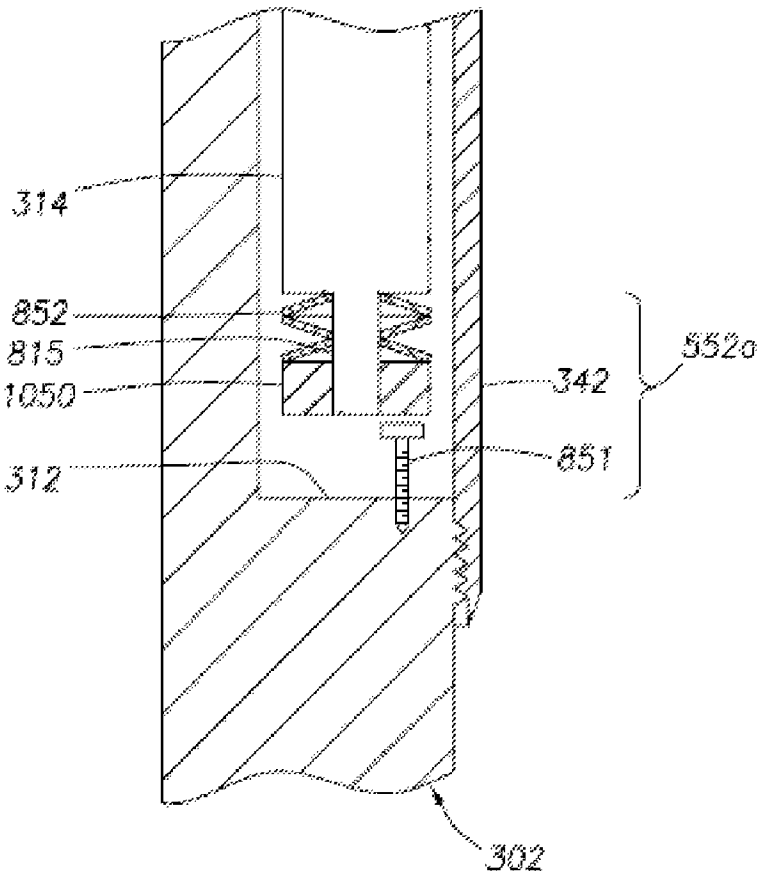

As shown in FIG. 6A, the retainer 552*a* includes an axial-loading device 1050 and a washer 852. An adjustable setscrew 851 is also provided between the drill collar 302 and the retainer 552*a* to adjustably position the sample chamber 314 within the drill collar. The washer may be a belleville stack washer or other spring mechanism to counteract drilling shock, internal pressure in the sample chamber and/or assist in shock absorption.

The sample chamber preferably has a tip 815 extending from an end thereof. The tip 815 is preferably provided to support washer 852 and axial loading device 1050 at an end of the sample chamber.

FIG. 6B shows an alternate shock absorber 552*b*. The retainer 552*b* is essentially the same as the retainer 552*a*, but does not have a setscrew 851. In this configuration, support is provided by cover 342'. Cover 342' operates the same as covers 342, but is provided with a stepped inner surface 343. The stepped inner surface defines a cover shoulder 343 adapted to support sample chamber 314 within drill collar 302.

Figure 6D:
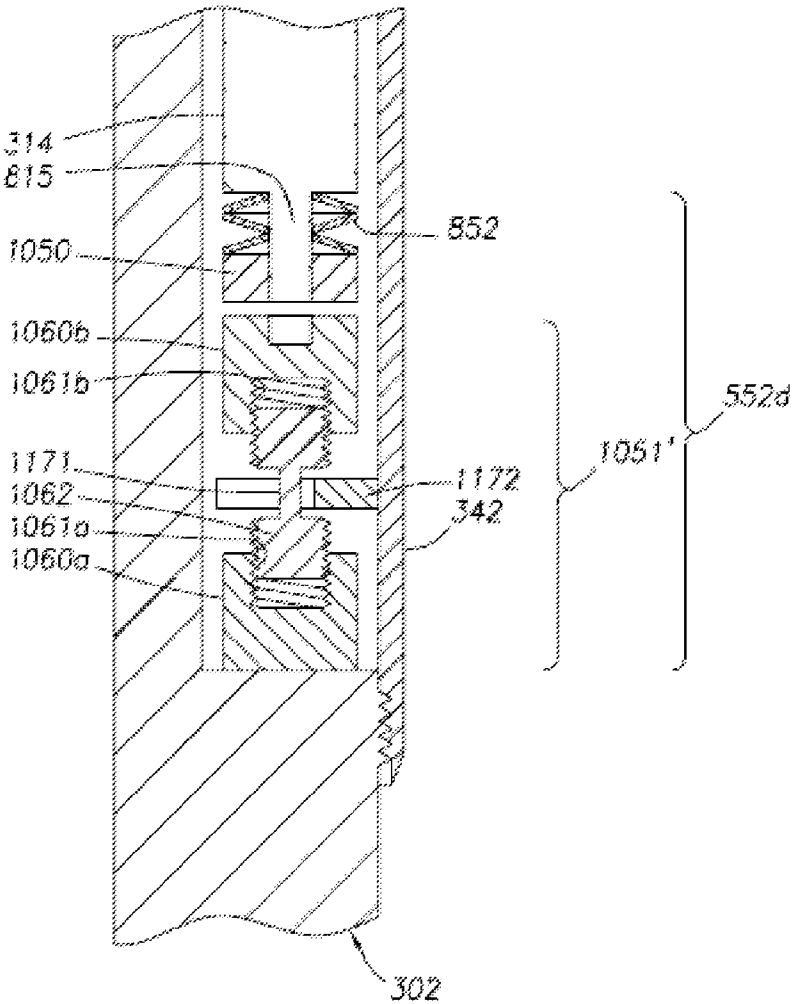
Figure 6C:
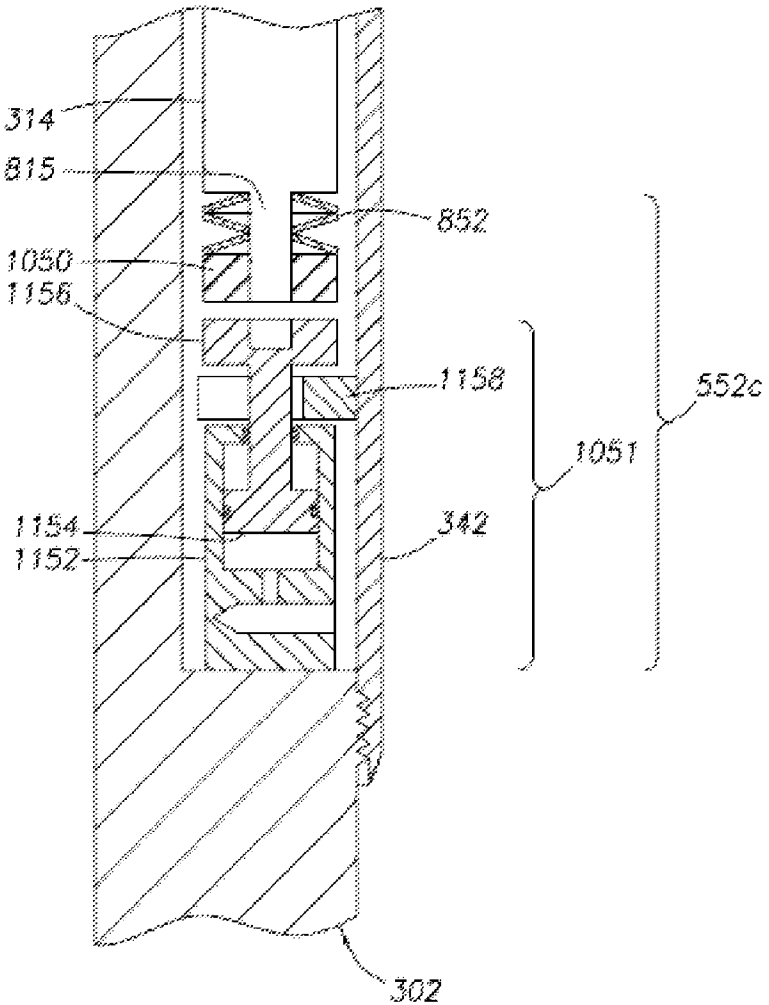

Referring now to FIG. 6C, the shock absorber 552*c* is the same as the shock absorber 552*a* of FIG. 6A, but is further provided with a hydraulic jack 1051. The hydraulic jack includes a hydraulic cylinder 1152, a hydraulic piston 1154, and a hydraulic ram 1156 that are operable to axially load the axial loading spacer 1050.

When the cover 342 is open (not shown), the hydraulic jack may be extended under pressurized hydraulic fluid (e.g., using a surface source) to fully compress the spring member 852. An axial lock (not shown) is then inserted and the pressure in the hydraulic cylinder 1152 may be released. The length of the axial lock is preferably dimensioned so that the counteracting spring force of the spring member is sufficient in the full temperature and/or pressure range of operation of the sample module, even if the sample module expands more than the sample chamber.

When the cover 342 is retracted (not shown), the hydraulic jack may be extended under pressurized hydraulic fluid (e.g., using a surface source) to fully compress the washer 852. An axial lock 1158 may then be inserted and the pressure in the hydraulic cylinder 1152 released. The length of the axial lock 1158 is preferably dimensioned so that the counteracting spring force of spring member is sufficient to operate in a variety of wellbore temperatures and pressures.

FIG. 6D depicts an alternate shock absorber 552*d* with an alternate jack 1051'. The shock absorber is the same as the shock absorber 552*c* of FIG. 6C, except that an alternate jack is used. In this configuration, the jack includes opposing lead screws 1060*a* and 1060*b*, rotational lock 1172 and a jackscrew 1062.

The jackscrew 1062 is engaged in opposing lead screws 1060*a* and 1060*b*. Opposing lead screws 1060*a* and 1060*b* are provided with threaded connections 1061*a* and 1061*b* for mating connection with threads on jackscrew 1062. When the cover 342 is open (not shown), the distance between opposing lead screws 1060*a* and 1060*b* may be increased under torque applied to a central, hexagonal link 1171 until a desirable compression of the spring member 852 is achieved. Then a rotation lock 1172 may be inserted around the central, hexagonal link 1171 to prevent further rotation.

Figure 7:
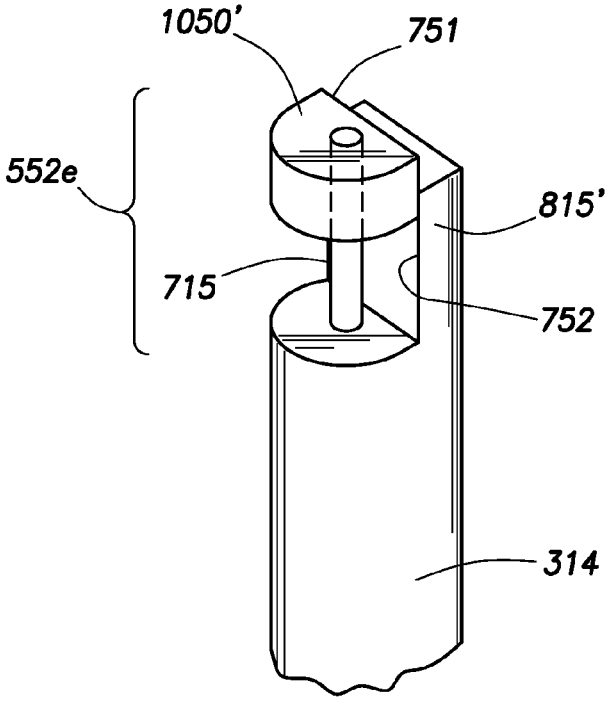
FIG. 7 is an isometric representation of an alternative shock absorber having a retainer usable with the sample module of FIG. 4A.

FIG. 7 illustrates an alternative retainer 552*e* usable as the shock absorber for a sample chamber, such as the one depicted in FIG. 4A. The retainer 552*e* includes an axial-loading spacer 1050' and a head component 715. Preferably, the axial load spacer has a flat sidewall 751 for engaging a complementing flat sidewall 752 of an end 815' of the sample chamber 314 and preventing relative rotation therebetween. The head component 715 is insertable into the axial loading spacer 1050' and the sample chamber to provide an operative connection therebetween. A spring member (not shown) may be provided about on a head component 815 of sample chamber 314 between the axial-loading spacer and the sample chamber.

Figure 8A:
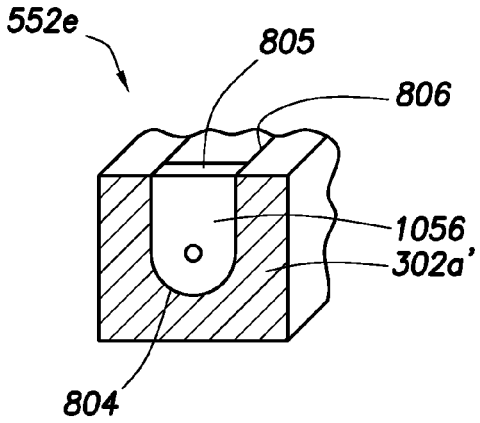
FIG. 8A is an alternate view of the shock absorber of FIG. 7 positioned in a drill collar.
Figure 8B:
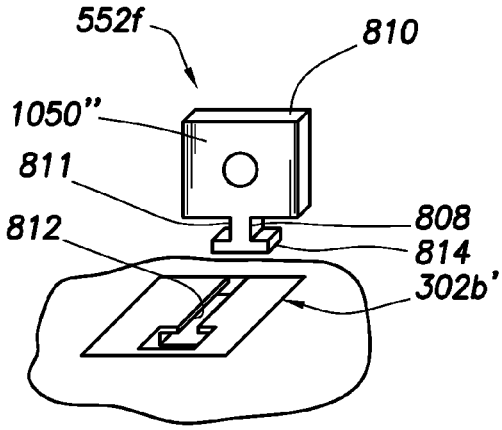
FIG. 8B is an exploded view of an alternate shock absorber and drill collar.
Figure 8C:
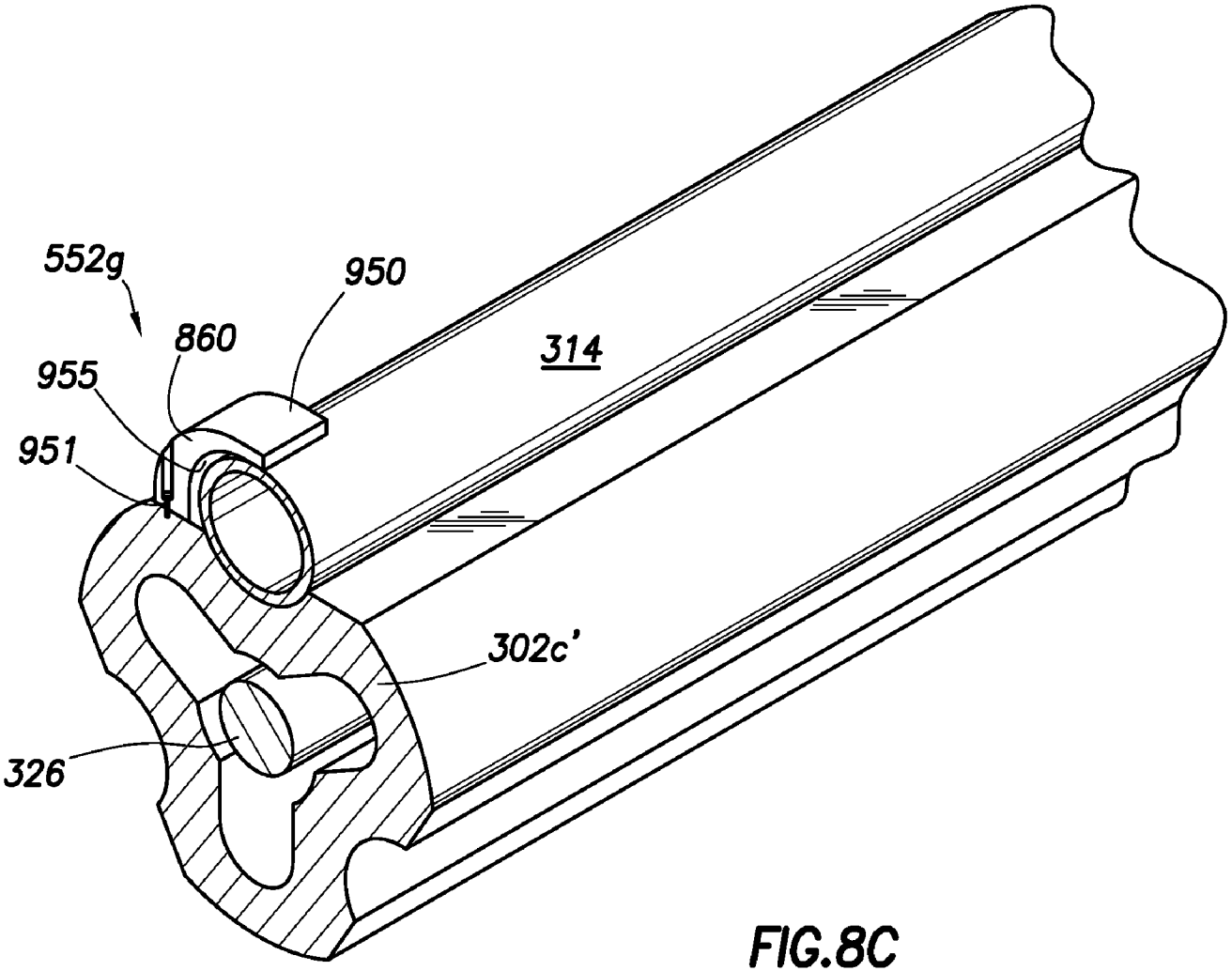
FIG. 8C is an isometric representation, partially in section, of an alternate shock absorber and drill collar.

FIGS. 8A-8C show alternative retainers usable with the sample chamber 314 of FIG. 7. FIG. 8A depicts the retainer 552*e* of FIG. 7 positioned in a drill collar 302*a*. FIG. 8B depicts an alternate retainer 552*f* having an axial-loading spacer 1050" having a key 808 insertable into a drill collar 302*b'*. FIG. 8C depicts an alternate retainer 552*g* having a radial retainer 860 operatively connected to a drill collar 302*c'*. The drill collars of these figures may be the same drill collar 302 as depicted in previous figures, except that they are adapted to receive the respective retainers. Preferably, these retainers and drill collars are adapted to prevent rotation and lateral movement therebetween, and provide torsional support.

As shown in FIG. 8A, the axial-loading spacers 1056 of retainer 552*e* has rounded and flat edge portions 804 and 805, respectively. Drill collar 302 has a rounded cavity 806 adapted to receive the axial loading spacer 1056.

In FIG. 8B, the retainer 552*e* includes an axial-loading spacer 1050" having a rectangular periphery 810 and a key 808 extending therefrom. The key 808 is preferably configured such that it is removably insertable into a cavity 812 in drill collar 302*b'*. As shown, the key has an extension 811 with a tip 814 at an end thereof. The tip 814 is insertable into cavity 812, but resists removal therefrom. The dimension of cavity 812 is preferably smaller than the tip 814 and provides an inner surface (not shown) that grippingly engages the tip to resist removal. In some cases, it may be necessary to break the tip 814 to enable removal of the sample chamber when desired. Optionally, the tip may be fabricated such that a predetermined force is required to permit removal. In this manner, it is desirable to retain the sample chamber 314 in position in the drill collar during operation, but enable removal when desired.

In FIG. 8C the alternative retainer 552*g* includes an arm 950 operatively connected to drill collar 302*c'*. The arm 950 is preferably connected to drill collar 302*c'* via one or more screws 951. Preferably, the arm 950 is radially movable in a hinge like fashion. The arm 950 has a concave inner surface 955 adapted to engage and retain sample chamber 314 in place in drill collar 302*c'*.

Preferably, the retainers provided herein permit selective removal of the sample chambers. One or more such retainers may be used to removably secure the sample chamber in the drill collar. Preferably, such retainers assist in securing the sample chamber in place and prevent shock, vibration or other damaging forces from affecting the sample chamber.

In operation, the sample module is threadedly connected to adjacent drill collars to form the BHA and drill string. Referring to FIG. 1, the sample module may be pre-assembled by loading the sample chamber 314 into the aperture 303 of the drill collar 302. The interface 550 is created by positioning and end of the sample chamber 314 adjacent the flowline 311.

The interface 550 (also known as a pre-loading mechanism) may be adjusted at the surface such that a minimum acceptable axial or other desirable load is applied to achieve the required container isolation in the expected operating temperature range of the sample module 220, thereby compensating for greater thermal expansion.

Retainer 552 may also be operatively connected to an opposite end of the sample chamber to secure the sample chamber in place. The cover 342 may then be slidably positioned about the sample chamber to secure it in place.

The interface 550 at the (lower) end with the hydraulic connection may be laterally fixed, e.g., by conical engagement surfaces 315, 317 (see, e.g. FIG. 5A) as described above. The retainer 552 at the opposite (upper) end typically constrains axial movement of the sample chamber 314 (see, e.g., FIGS. 6A-8C). The two work together to hold the sample chamber within the drill collar 302. The cover 342 is then disposed about the sample chamber to seal the opening 305 of the sample chamber as shown, for example in FIG. 4A.

One or more covers, shock absorbers, retainers, sample chambers, drill collars, wet stabbers and other devices may be used alone and/or in combination to provide mechanisms to protect the sample chamber and its contents. Preferably redundant mechanisms are provided to achieve the desired configuration to protect the sample chamber. As shown in FIG. 4, the sample chamber may be inserted into the drill collar 302 and secured in place by interface 550, retainer 552 and cover 342. Various configurations of such components may be used to achieve the desired protection. Additionally, such a configuration may facilitate removal of the sample chamber from the drill collar.

Once the sample module is assembled, the downhole tool is deployed into the wellbore on a drillstring 12 (see FIG. 1). A sampling operation may then be performed by drawing fluid into the downhole tool via the fluid communication module 210 (FIG. 1). Fluid passes from the fluid communication module to the sample module via flowline 310 (FIG. 2A). Fluid may then be diverted to one or more sample chambers via flow diverter 332 (FIG. 3).

Valve 330*b* and/or 330*a* may remain open. In particular, valve 330*b* may remain open to expose the backside of the chamber piston 360 to wellbore fluid pressure. A typical sampling sequence would start with a formation fluid pressure measurement, followed by a pump-out operation combined with in situ fluid analysis (e.g., using an optical fluid analyzer). Once a certain amount of mud filtrate has been pumped out, genuine formation fluid may also be observed as it starts to be produced along with the filtrate. As soon as the ratio of formation fluid versus mud filtrate has reached an acceptable threshold, a decision to collect a sample can be made. Up to this point the liquid pumped from the formation is typically pumped through the probe tool 210 into the wellbore via dump flowline 260. Typically, valves 328 and 335 are closed and valve 334 is open to direct fluid flow out dump flowline 260 and to the wellbore.

After this flushing is achieved, the electrical valves 328*a* may selectively be opened so as to direct fluid samples into the respective sample cavities 307 of sample chambers 314. Typically, valves 334 and 335 are closed and valves 328*a*, 328*b* are opened to direct fluid flow into the sample chamber.

Once a sample chamber 314 is filled as desired the electrical valves 328*b* may be moved to the closed position to fluidly isolate the sample chambers 314 and capture the sample for retrieval to surface. The electrical valves 328*a*, 328*b* may be remotely controlled manually or automatically. The valves may be actuated from the surface using standard mud-pulse telemetry, or other suitable telemetry means (e.g., wired drill pipe), or may be controlled by a processor (not shown) in the BHA 100.

The downhole tool may then be retrieved from the wellbore 11. Upon retrieval of the sample module 220, the manually-operable valves 330*a, b* of sample chamber 314 may be closed by opening the cover 342 to (redundantly) isolate the fluid samples therein for safeguarded transport and storage. The closed sample cavities 312 are then opened, and the sample chambers 314 may be removed therefrom for transporting the chambers to a suitable lab so that testing and evaluation of the samples may be conducted. Upon retrieval, the sample chambers and/or module may be replaced with one or more sample modules and/or chambers and deployed into the wellbore to obtain more samples.

It will be understood from the foregoing description that various modifications and changes may be made in the preferred and alternative embodiments of the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open set or group. Similarly, the terms "containing," having," and "including" are all intended to mean an open set or group of elements. "A," "an" and other singular terms are intended to include the plural forms thereof unless specifically excluded. It is the express intention of the applicant not to invoke 35 U.S.C. §112, paragraph 6 for any limitations of any of the claims herein, except for those in which the claim expressly uses the words "means for" together with an associated function.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a fluid communication device configured to extend from a drill string and establish fluid communication with a subterranean formation penetrated by a wellbore in which the drill string comprises a passage configured to conduct drilling mud and an opening extending through an outer surface thereof and into a cavity; and a sample container coupled within the cavity and in selectable fluid communication with the formation via the fluid communication device, wherein the sample container is detachably coupled within the cavity;

wherein the cavity comprises a plurality of cavities, the opening comprises a plurality of openings each opening extending through the outer surface and into a corresponding one of the plurality of cavities, and the passage comprises a plurality of lobes each lobe positioned between neighboring ones of the plurality of cavities.

2. The apparatus of claim 1 further comprising a flow device configured to selectively position the fluid communication device in fluid communication with the wellbore.

3. The apparatus of claim 1 further comprising a flow device configured to selectively position the fluid communication device in fluid communication with:

the wellbore in a first position; and the sample container in a second position.

4. The apparatus of claim 3 further comprising a retainer configured to fluidly connect the sample container to the flow device.

5. The apparatus of claim 4 wherein the retainer comprises a shock absorber.

6. The apparatus of claim 5 wherein the shock absorber comprises a jack, an axial loading device, an axial loading spacer, or a key.

7. A method, comprising:

coupling a detachable sample container within a cavity in an outer surface of a drill string, wherein the drill string comprises a passage configured to conduct drilling mud;

positioning the drill string in a wellbore penetrating a subterranean formation;

extending a fluid communication device from the drill string, thereby establishing fluid communication with the formation;

withdrawing fluid from the formation via the fluid communication device; and passing the withdrawn formation fluid into the sample container; wherein passing the withdrawn formation fluid into the sample container comprises operating a flow device configured to selectively position the fluid communication device in alternative fluid communication with the sample container and the wellbore.

8. The method of claim 7 further comprising retrieving the drill string to the surface.

9. The method of claim 8 further comprising removing the sample container from the cavity.

10. The method of claim 7 wherein coupling the sample container within the cavity comprises operating a retainer configured to fluidly connect the sample container to the flow device.

11. An apparatus, comprising:

a fluid communication device configured to extend from a drill string and establish fluid communication with a subterranean formation penetrated by a wellbore in which the drill string is positioned, wherein the drill string comprises a passage configured to conduct drilling mud and an opening extending through an outer surface thereof and into a cavity;

a sample container coupled within the cavity and in selectable fluid communication with the formation via the fluid communication device, wherein the sample container is detachably coupled within the cavity; and a flow device configured to selectively position the fluid communication device in fluid communication with:

the wellbore in a first position; and the sample container in a second position.

12. The apparatus of claim 11 further comprising a retainer configured to fluidly connect the sample container to the flow device.

13. The apparatus of claim 12 wherein the retainer comprises a shock absorber.

14. The apparatus of claim 12 wherein the shock absorber comprises a jack, an axial loading device, an axial loading spacer, or a key.

* * * * *